US006553805B1

(12) United States Patent
Gruber

(10) Patent No.: US 6,553,805 B1
(45) Date of Patent: Apr. 29, 2003

(54) DOUBLE-LANCED SUSPENSION

(75) Inventor: Samuel A. Gruber, Freeport, PA (US)

(73) Assignee: J. V. Manufacturing Co., Inc., Natrona Heights, PA (US)

( * ) Notice: Subject to any disclaimer, the term of this patent is extended or adjusted under 35 U.S.C. 154(b) by 0 days.

(21) Appl. No.: 10/136,112

(22) Filed: May 1, 2002

(51) Int. Cl.[7] ..... B21D 28/10

(52) U.S. Cl. ..... 72/336; 72/330; 72/324; 83/25

(58) Field of Search ..... 72/336, 335, 339, 72/337, 331, 330, 324; 83/25, 103, 695, 678; 225/103, 104; 428/597, 132, 131, 571

(56) References Cited

U.S. PATENT DOCUMENTS 1,210,849 A * 1/1917 Scammell ..... 52/454
1,212,863 A * 1/1917 White ..... 29/6.2
1,714,058 A * 5/1929 Tirifahy ..... 52/672
2,350,004 A * 5/1944 Whistler ..... 428/571
2,558,185 A * 6/1951 Leisen ..... 428/596
3,788,118 A * 1/1974 Joseph ..... 72/324
4,114,417 A 9/1978 LaVene
4,258,458 A * 3/1981 Danna ..... 428/597
4,291,567 A 9/1981 Murayama
4,545,170 A * 10/1985 Shirey ..... 428/597
4,554,404 A * 11/1985 Gilder et al. ..... 174/52.4
4,785,655 A * 11/1988 Pistritto et al. ..... 72/326
4,879,084 A * 11/1989 Parnigoni ..... 29/6.1
5,725,930 A * 3/1998 Ziberna ..... 428/131
6,003,359 A 12/1999 Futamura et al.
6,378,351 B1 * 4/2002 Ouchi et al. ..... 72/336

* cited by examiner

*Primary Examiner*—Daniel C. Crane
(74) *Attorney, Agent, or Firm*—Jones, Tullar & Cooper, P.C.

(57) ABSTRACT

A double-lanced suspension for use in progressive-die forming methods. The suspension is characterized by a rim section of lesser expanse between pairs of connecting tabs than is used in the prior double-lanced suspension.

12 Claims, 6 Drawing Sheets

DOUBLE-LANCED SUSPENSION

TECHNICAL FIELD

The present invention relates to a method of preparing ductile material for processing in progressive dies and to manufactures associated with the method.

BACKGROUND ART

In the drawing of ductile metal sheet using progressive dies, a double-lanced suspension provides a blank whose structure can be progressively changed at different stations to form a press-drawn part. Connecting tabs maintain the location of the developing part on the sheet, so that the sheet can be moved to bring the developing part to the various stations containing the different tools of the die.

A commonly-used double-lanced suspension is initiated by slitting a sheet metal strip along circular arcs having two radii, one of an inner circle and one of an outer circle. The radius of the outer circle is only slightly larger than the radius of the inner circle.

Typically, two arcs are slit on the inner circle and two on the outer. The two arcs on the inner circle are opposite one another, and each arc may extend, for instance, 160-degrees, so that two oppositely lying, unslit, 20-degree segments remain. The two arcs on the outer circle are then centered on the 20-degree, unslit segments, and these two arcs may each extend 80-degrees.

U.S. Pat. No. 4,114,417 shows such double-lanced architecture at station 40b in its FIG. 5*a*. The same is shown in FIG. 12 of U.S. Pat. No. 4,291,567, while station 23 in FIG. 3 of U.S. Pat. No. 6,003,359 shows a doubling of the usual architecture. U.S. Pat. No. 4,114,417 is incorporated here in its entirety by reference, for the purpose of disclosing basic progressive-die, metal-drawing practice. U.S. Pat. No. 4,114,417 seems to be innacurate in its FIGS. 5*a* and 6*a* for not showing the gaps that occur at the sides of the blank as it is formed, but otherwise is good for its showing of the basic steps and progress in the forming of a part in progressive die practice.

DISCLOSURE OF INVENTION

It is an object of the invention to provide a ductile material processing method creating an improved double-lanced suspension.

Another object of the invention is the provision of manufactures exhibiting an improved double-lanced suspension.

These objects (as well as other objects which will become apparent from the discussions below) are achieved by:

a ductile material forming method including the steps of slitting a ductile material on two separated segments of an inner perimeter, thereby leaving two spacing zones on the inner perimeter, and slitting the material on two separated segments of an outer perimeter, the two segments of the outer perimeter deviating toward the two spacing zones of the inner perimeter; and a manufacture including a blank of ductile material held to surrounding ductile material by four connecting tabs in two sets of two tabs each, the two tabs of a set extending toward one another, each from a surrounding-material-connected end to a blank-connected end, the blank-connected ends of the tabs of a set having a space between one another, the surrounding material protruding into said space.

MODES OF THE INVENTION

Figures 1A, 1B:
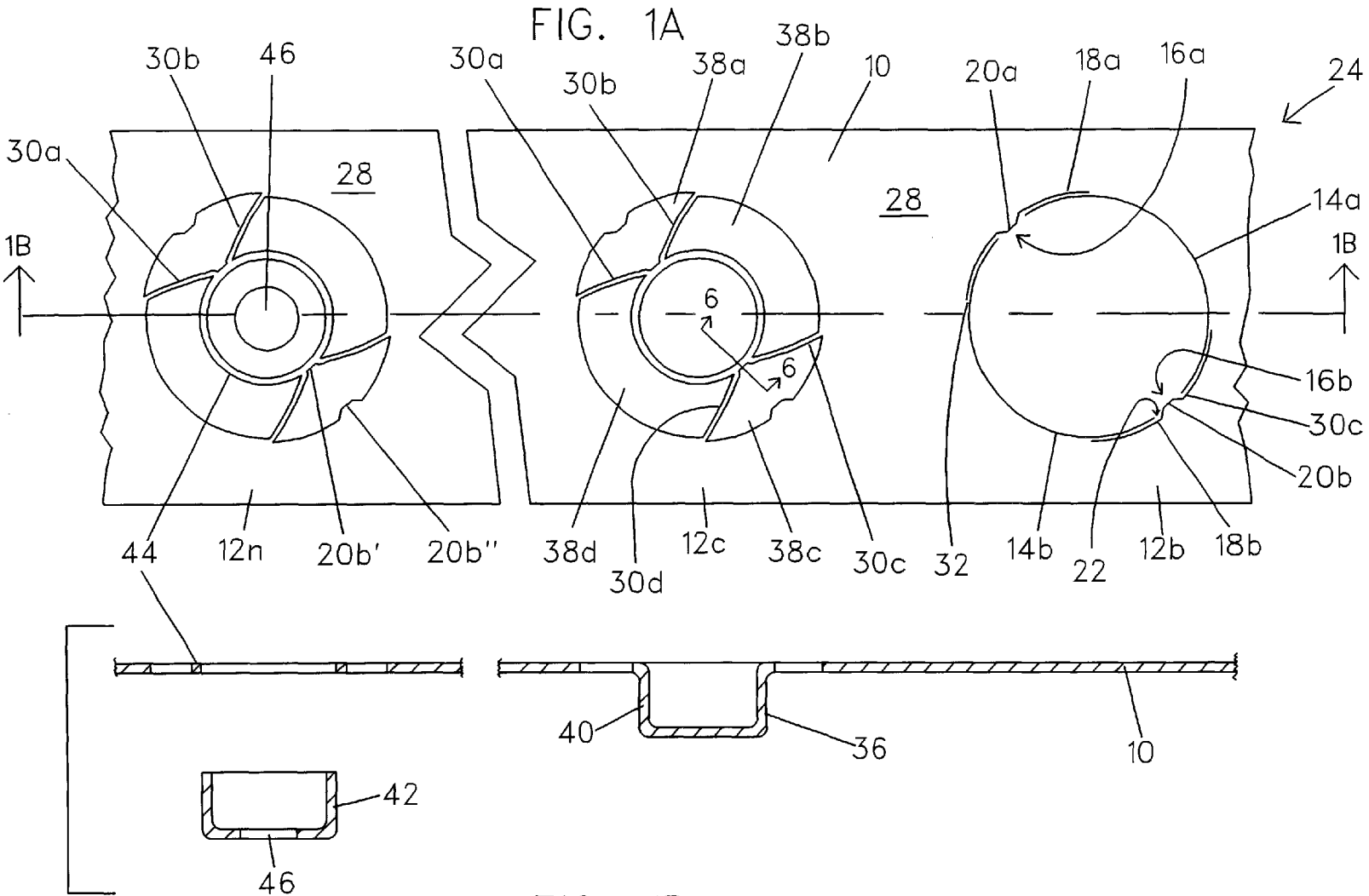
FIG. 1A is a plan view of a metal strip processed and structured according to the invention.
FIG. 1B is a cross section taken on cutting plane 1B—1B of FIG. 1A.

FIGS. 1A and 1B show a sheet metal strip 10 illustrating three stations 12*b,c,n* of a progressive-die, metal-working process utilizing an improved double-lanced suspension of the invention. As indicated by the breaks in FIGS. 1A and 1B and the arbitrarily chosen jump in the station indexing from "c" to "n", certain stations have been omitted from the drawing, since their illustration would not contribute any additional information as to the nature of the suspension of the invention.

In illustration of a method of the invention, at station 12*b,* the ductile material of the strip is slit, or lanced, on two separated segments 14*a,b* of an inner perimeter, which is preferably circular, as shown. Segments 14*a,b* lie opposite one another on the inner perimeter. With segments 14*a,b* being separated and opposite, this leaves two spacing zones 16*a,b* on the inner perimeter between the segments 14*a,b.* The length of the spacing zones 16*a,b* on the inner perimeter is small relative to the length of the slit segments 14*a,b.* For instance, where the inner perimeter is circular, spacing zone 16*a* may extend over 20-degrees of arc, compared to 160 degrees for slit segment 14*a.*

Additionally at station 12*b,* the material has been slit on two separated segments 18*a,b* of an outer perimeter, which is also preferably circular and concentric with the circle of the inner perimeter, as depicted in the drawing. The two segments 18*a,b* of the outer perimeter arc opposite one another, centered on the two spacing zones 16*a,b* of the inner perimeter, and deviate at their centers toward the two spacing zones 16*a,b.* Preferably, the deviation is sufficient that segments 18*a,b* coincide with the inner perimeter at their segment portions, or slits, 20*a,b.* However, the deviation is not such as to cause an intersection of segments 18*a,b* with segments 14*a,b,* and segment portions 20*a,b* remain spaced from segments 14*a,b* by small isthmuses 22 whose width is about equal to the difference in the radii of the outer and inner perimeters. Segments 18*a,b* each extend through 80 degrees of arc, for example.

Figure 2:
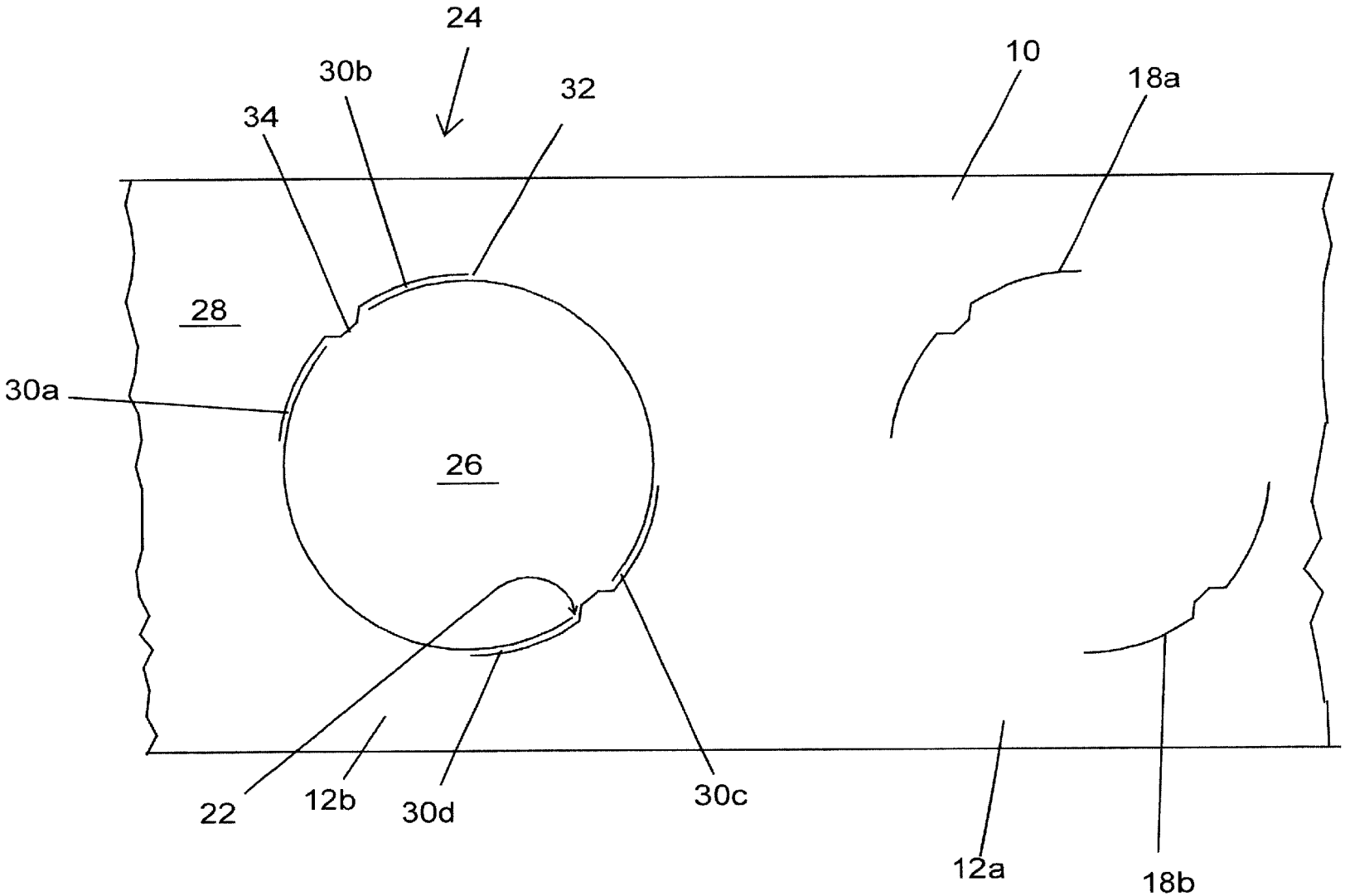
FIG. 2 is a plan view of a metal strip processed and structured according to a modification of the invention as compared to the mode illustrated in FIG. 1A.

As will be evident to those skilled in the art, segments 14*a,b* and 18*a,b* may be slit at the one station 12*b* using a compound die. Alternatively, segments 14*a,b* may be slit at a first station, and segments 18*a,b* at a subsequent station, or vice versa. Thus, the claims below are intended to cover any of these ways of proceeding: first 14*a,b,* then 18*a,b,* at separate stations; first 18*a,b,* then 14*a,b,* at separate stations; or 14*a,b* and 18*a,b* at the same time at one station using a compound die. FIG. 2 illustrates the case where segments 18*a,b* are slit at a station 12*a,* and then segments 14*a,b* are,slit at a subsequent station 12*b.*

A method of the invention, such as the methods described in the previous paragraphs, leads to a manufacture 24 of the invention. This manufacture is shown in FIGS. 1A and 2 and includes a blank 26 of ductile material held to surrounding ductile material 28 by four connecting tabs 30*a,b,c,d* in two sets of two tabs each, 30*a,b* in one set and 30*c,d* in the other. The two tabs of a set extend toward one another, each from a surrounding material connected end 32 to a blank connected end, isthmus 22. The blank connected ends of the tabs of a set have a space 34 between one another. Surrounding material 28 protrudes into space 34.

Manufacture 24 may be used, for example, to form a cap for a bottle, or vial. The forming of an exemplary cap is illustrated at stations 12*c* and 12*n* of FIGS. 1A and 1B.

At station 12*c,* dies (not shown) have come together to form blank 26 into the cup shape 36 of a cap. The metal flow in the drawing of the cup shape has shrunk the diameter of the blank, to open up gaps 38*a,b,c,d,* and connecting tabs 30*a,b,c,d* have been bent symetrically inwards to keep the cup shape centered (as seen in the plan view of FIG. 1A) on the space originally occupied by blank 26.

Compressive metal flow in the skirt 40 of the cup shape has moved the ends 22 of the tabs of each set of tabs closer together, as indicated by comparison, for example, of the length of inner edge 20*b*' of segment portion 20*b* with its undisturbed outer edge 20*b*" in surrounding material 28. Inner edge 20*b*' and outer edge 20*b*" have been indicated on the drawing at station 12*n,* because of the congestion of lead lines and cutting plane at station 12*c*.

At station 12*n,* cup shape 36 has been cut, or sheared, free from metal strip 10 as cap 42, leaving scrap ring 44 behind, hanging from tabs 30*a,b,c,d*. A window 46 formed in an intervening station (not shown) is located in the floor of the cap. A rubber panel (not shown) may later be mounted in the window, to provide access via a syringe to the interior of a pharmaceutical vial crowned by the cap.

Figure 3A:
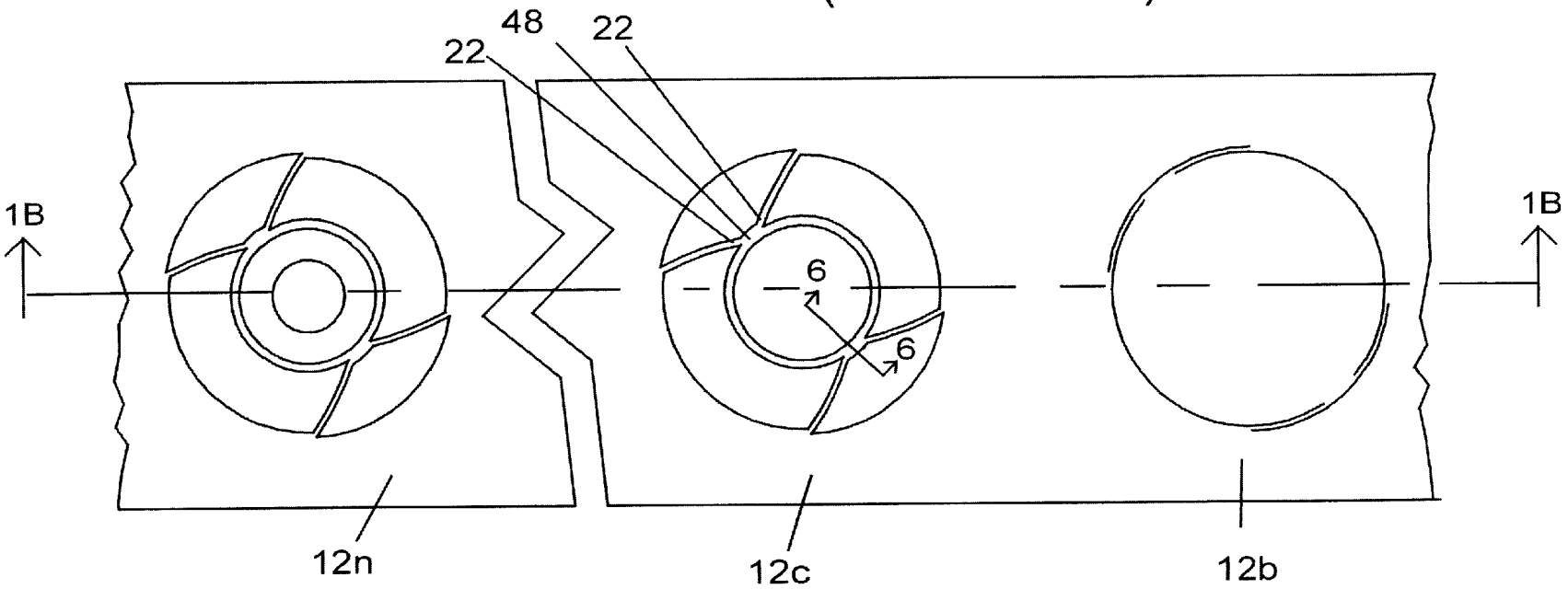
FIG. 3A (PRIOR ART)
FIG. 3A is a plan view of a metal strip processed and structured as in the prior art.
Figure 3B:
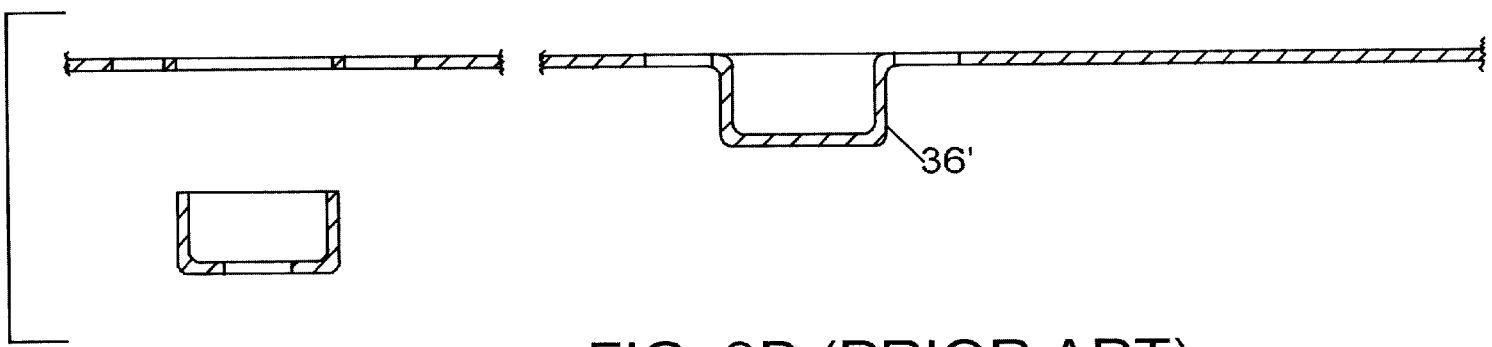
FIG. 3B (PRIOR ART)
FIG. 3B is a cross section taken on cutting plane 3B—3B of FIG. 3A.
Figure 4:
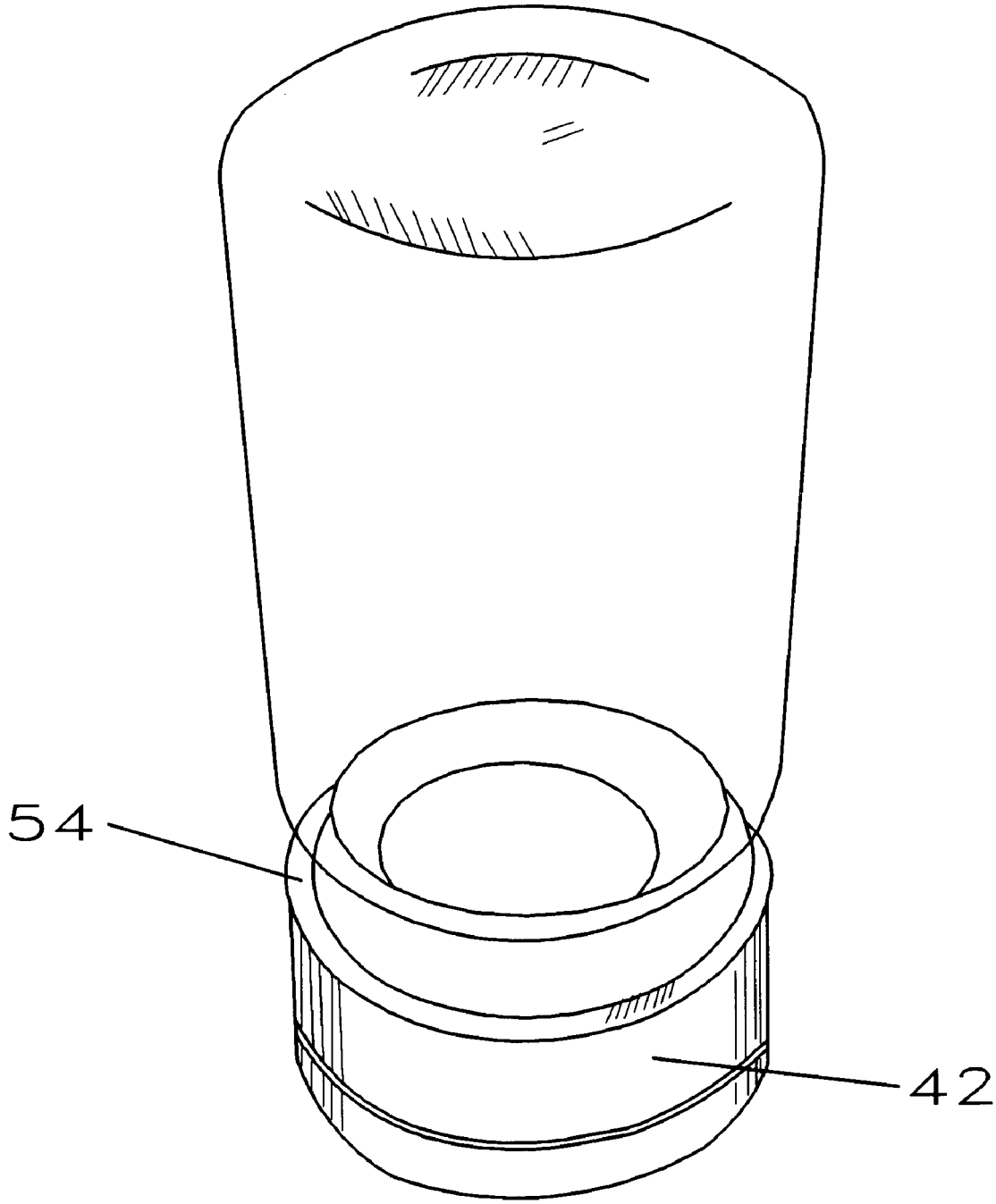
FIGS. 4 and 5 are perspective views of pharmaceutical vials.

FIGS. 3A and 3B show stations 12*b,c,n* for the double-lanced suspension of the prior art. Of note is the different appearance of the rim of cup shape 36' in FIG. 3A at station 12*c,* compared with how the rim looks in FIGS. 1A at station 12*c* for cup shape 36. At station 12*c* in FIG. 3A, the rim is reinforced in the space between the tab ends 22 of each set of tabs by a broader expanse 48 of sheet metal than is the case at the corresponding location in FIG. 1A at station 12*c*.

The broader expanse 48 acts as a reinforcement resisting compressive metal flow at that location at the rim during forming of the cup shape and leads to non-uniform properties in the rim which leads to non-uniform crimping, when the cap is crimped onto the opening of a bottle or vial. The double-lanced suspension of the invention eliminates this non-uniformity.

Figure 6:
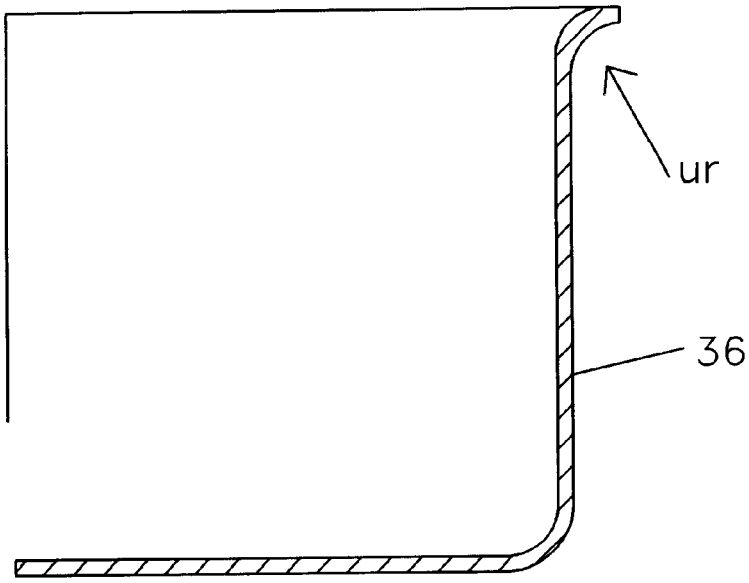
FIGS. 6 and 7 are detail views of portions of the cup shapes of FIGS. 1B and 3B, respectively.
Figure 7:
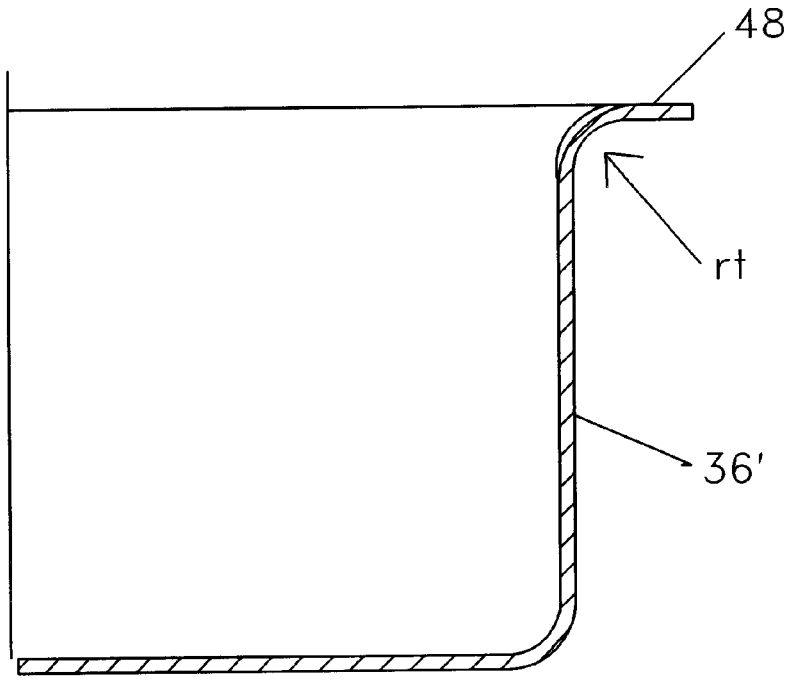
FIG. 7 (PRIOR ART)

The cross sections of FIGS. 6 and 7 point out the relative thinning (see "rt" in FIG. 7) of the rim which occurs at the location of expanse 48 in the prior art (FIG. 7), compared with the uniform rim "ur" at the same location in the case of the present invention (FIG. 6).

Figure 5:
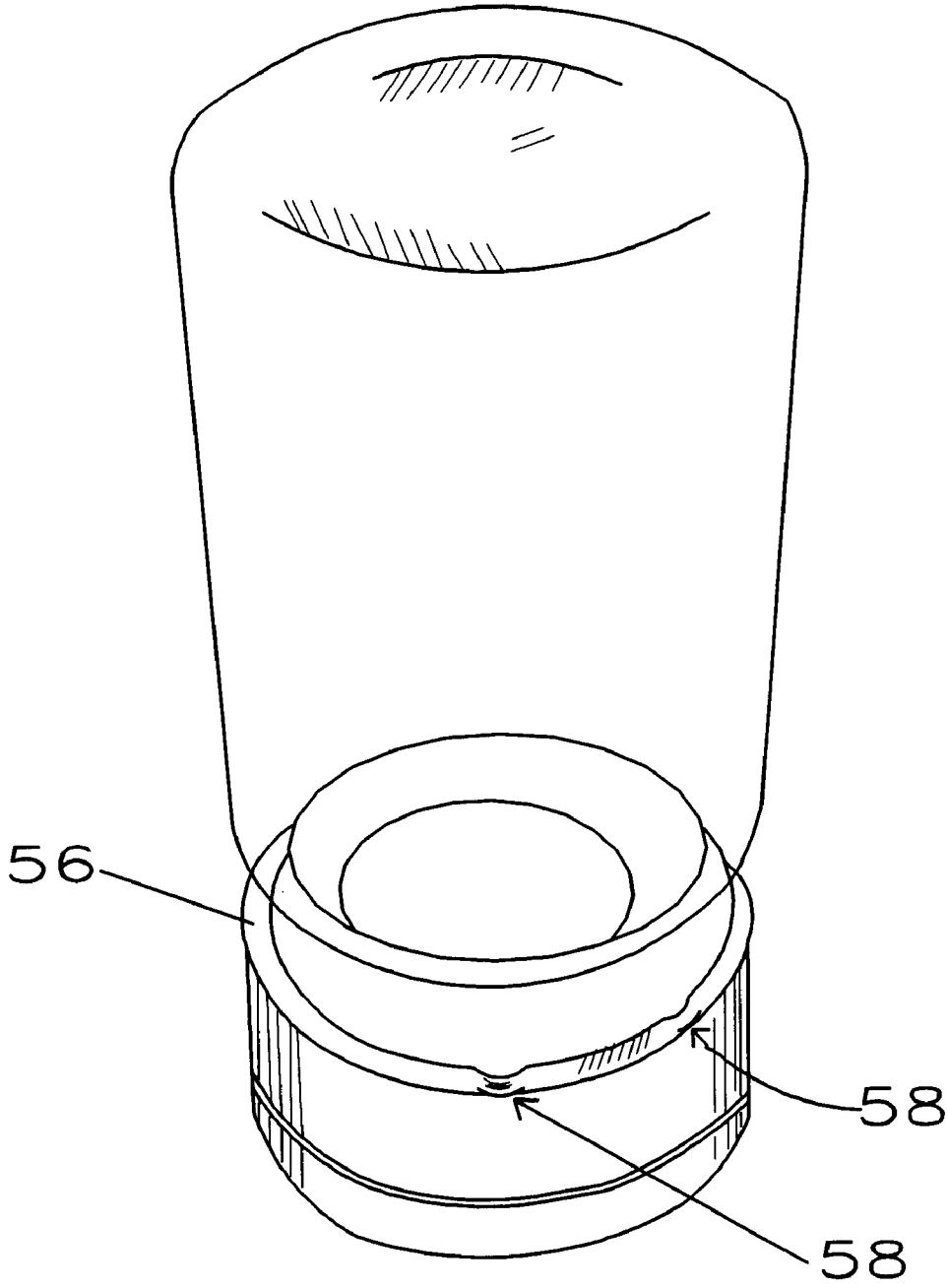
FIG. 5 (PRIOR ART)

The effect of the difference is illustrated by the uniform crimp 54 onto a pharmaceutical vial for a cap 42 made using the double-lanced suspension of the present invention, compared with the non-uniform crimp 56 of FIG. 5 for a cap made using the prior double-lanced suspension. Crimp 56 is non-uniform, as marked by unsightly undulations 58 resulting from the interaction of the crimp forming tool with non-uniform metal properties as the tool proceeds around the rim of the cap 42.

As an additional advantage, it has been found that the double-lanced suspension of the invention is less susceptible to breaking of the connecting tabs during processing of the blank in progressive dies than is the prior double-lanced suspension.

There follows, now, the claims. It is to be understood that the above are merely preferred modes of carrying-out the invention and that various changes and alterations can be made without departing from the spirit and broader aspects of the invention as defined by the claims set forth below and by the range of equivalency allowed by law.

What is claimed is:

1. In a ductile material forming method, wherein a blank (26) is processed to a press-drawn part (42), the improvement for creating the blank comprising the steps of slitting a ductile material (28) on two separated segments of an inner perimeter around the blank to form two separated slit segments (14*a,b*) to define the blank with an area sufficient for press-drawing into a part, thereby leaving two spacing zones (16*a,b*) of un-slit material on the inner perimeter between the two separated slit segments, and slitting the material on two separated segments of an outer perimeter outside the inner perimeter around the blank to form two separated slit segments (18*a,b*), the two separated slit segments of the outer perimeter each having a slit (20*a,b*) that follows the inner perimeter and deviates toward a respective one of the two, spacing zones.

2. A method as claimed in claim 1, wherein the perimeters are circular and concentric.

3. A method as claimed in claim 2, wherein the slit (20*a,b*) deviates sufficiently to coincide with the inner perimeter.

4. A method as claimed in claim 1, wherein the forming method is a progressive die forming method.

5. A ductile material forming method comprising the steps of slitting a ductile material (28) on two separated segments of an inner perimeter to form two separated slit segments (14*a,b*) to define a blank (26) with an area sufficient for press-drawing into a part (42), thereby leaving two spacing zones (16*a,b*) of un-slit material on the inner perimeter between the two separated slit segments, and slitting the material on two separated segments of an outer perimeter outside the inner perimeter around the blank to form two separated slit segments (18*a,b*), the two separated slit segments of the outer perimeter each having a slit (20*a,b*) that follows the inner perimeter and deviates toward a respective one of the two spacing zones, the steps of slitting causing the blank to be suspended in the ductile material by tabs, and subsequently forming the blank to a free, press-drawn part.

6. A method as claimed in claim 5, wherein the perimeters are circular and concentric.

7. A method as claimed in claim 6, wherein the slit (20*a,b*) deviates sufficiently to coincide with the inner perimeter.

8. A method as claimed in claim 5, wherein the step of forming comprises moving the suspended blank through a plurality of stations and progressively changing the structure of the blank at the stations.

9. A ductile material forming method comprising the steps of slitting a ductile material (28) on twvo separated segments of an inner perimeter to form two separated slit segments (14*a,b*) around an area of the ductile material to define a blank (26) of area sufficient for press-drawing into a part (42), thereby leaving two spacing zones (16*a,b*) of un-slit material on the inner perimeter between the two separated slit segments, and slitting the material on two separated segments of an outer perimeter outside the inner perimeter around the blank to form two separated slit segments (18*a,b*), the two separated slit segments of the outer perimeter each having a slit (20*a,b*) that follows the inner perimeter and deviates toward a respective one of the two spacing zones.

10. A method as claimed in claim 9, wherein the perimeters are circular and concentric.

11. A method as claimed in claim 10, wherein the slit (20*a,b*) deviates sufficiently to coincide with the inner perimeter.

12. A method as claimed in claim 9, wherein the forming method is a progressive die forming method.

* * * * *